US007184065B2

(12) United States Patent
Shin

(10) Patent No.: US 7,184,065 B2
(45) Date of Patent: Feb. 27, 2007

(54) FLAT PANEL DISPLAY WITH BRIGHTNESS CORRECTION

(75) Inventor: Dong-Yong Shin, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 404 days.

(21) Appl. No.: 10/442,055

(22) Filed: May 21, 2003

(65) Prior Publication Data

US 2004/0041823 A1 Mar. 4, 2004

(30) Foreign Application Priority Data

Aug. 27, 2002 (KR) ..... 10-2002-0050813

(51) Int. Cl.
*G09G 5/10* (2006.01)

(52) U.S. Cl. ..... 345/690; 345/76; 345/82

(58) Field of Classification Search ..... 345/82–83, 345/87–100, 690, 698, 76
See application file for complete search history.

(56) References Cited

U.S. PATENT DOCUMENTS 4,990,904 A * 2/1991 Zenda ..... 345/3.3
5,748,175 A * 5/1998 Shimada et al. ..... 345/660
5,844,539 A * 12/1998 Kitagawa ..... 345/100
5,945,972 A * 8/1999 Okumura et al. ..... 345/98
6,078,302 A * 6/2000 Suzuki ..... 345/77
6,473,077 B1 * 10/2002 Takenaka et al. ..... 345/209

FOREIGN PATENT DOCUMENTS

CN 1251932 5/2000

* cited by examiner

*Primary Examiner*—Xiao Wu
(74) *Attorney, Agent, or Firm*—Robert E. Bushnell, Esq.

(57) ABSTRACT

The present invention is directed to a flat panel display whose brightness is adjusted based on inputted signals. In the flat panel display of the present invention, the pixels of the display panel are formed with capacitors for temporarily storing voltages corresponding to signals applied to the data lines responding to the scan signals applied to the scan lines and the pictures are displayed based on the voltages stored in the capacitors. Also, the display period controller controls a first period for storing a first voltage corresponding to a gray level of a picture to be displayed in the capacitors during one frame and a second period for storing a second voltage representing a black level in the capacitors, depending on a first signal representing a brightness level. Accordingly, the brightness of a variety of levels can be expressed without having to adjust a level of data voltage.

21 Claims, 6 Drawing Sheets

FLAT PANEL DISPLAY WITH BRIGHTNESS CORRECTION

CLAIM OF PRIORITY

This application makes reference to, incorporates the same herein, and claims all benefits accruing under 35 U.S.C. §119 from an application for FLATPANEL DISPLAY earlier filed in the Korean Intellectual Property Office on Aug. 27, 2002 and there duly assigned Serial No. 2002-50813.

BACKGROUND OF THE INVENTION

1. Field of Invention

The present invention relates to a flat panel display, and particularly to an active matrix-typed flat panel display, whose brightness is corrected based on inputted signals.

2. Description of the Related Art

In recent years, according to a trend toward more lightweight and small-size electronic equipment such as personal computers and TVs (televisions), display devices have become required to be reduced in size and weight. This requirement has led to the development of flat panel displays rather than cathode ray tubes (CRT).

Such flat panel displays include a liquid crystal display (LCD), a field emission display (FED), an electroluminescent display, a plasma display panel (PDP), etc.

Typically, an active matrix-typed flat panel display including a plurality of pixels arranged in a matrix form displays pictures by controlling brightness of each pixel based on given brightness information. As a kind of active matrix-typed flat panel display, a liquid crystal display is a display device in which transmittance of a pixel is varied depending on a voltage applied thereto. In addition, an organic electroluminescent display is a display device in which a fluorescent organic compound is electrically excited and light is emitted from the excited compound.

In order to represent various levels of brightness in such a flat panel display, methods in which a display controller controls voltages of picture signals depending on brightness of ambient light have been conventionally used. However, there generally exists a limit to a level of data voltage expressible in a data driver, the level having a one-to-one correspondence to a gray level.

For example, assuming that a data voltage has 64 levels between 0 V (volt) and 5 V, when a white level is set to 3V in order to represent low brightness, a level of data voltage can have only levels between 3 V to 5 V. In other words, when the picture is displayed with low brightness, the number of expressible gray levels is reduced.

SUMMARY OF THE INVENTION

It is an object of the present invention to provide a flat panel display that corrects brightness based on inputted signals.

It is another object of the present invention to provide a flat panel display that has brightness of a variety of levels that can be expressed without an adjustment of the data voltage.

It is yet another object to provide a flat panel display in which one frame is divided into the display period in which a desired picture is displayed and the blank period in which a picture of the black level is displayed, the brightness can be expressed by controlling the display period and the blank period properly.

It is still another object to provide a flat panel display that efficiently corrects brightness and is easy and inexpensive to manufacture and implement.

In accordance with the present invention, a flat panel display for expressing a variety of brightness is provided. The present invention uses one frame which is divided into a display period and a blank period.

The flat panel display according to one aspect of the present invention includes a display panel including a plurality of scan lines and a plurality of data lines, intersecting each other, and a plurality of pixels for displaying pictures based on signals applied to the plurality of data lines in response to signals applied to the plurality of scan lines. A display period controller receives a first signal and then produces a second signal having first and second enable intervals during one frame, and a scan driver delivers the second signal to the plurality of scan lines in turn. One frame is divided into a first period between the first and second enable intervals and a second period between the second enable interval and an end point of the frame, and the pixels display pictures having a desired gray level in one of the first and second periods and pictures having a black level in the other of the first and second periods.

Preferably, the display period controller receives a third signal having a plurality of enable intervals during one frame, selects two enable intervals depending on a level of brightness, and produces the second signal with a correspondence of the two selected enable intervals to the first and second enable intervals.

Preferably, the pixels include storage elements for storing signals corresponding to signals applied from the data lines. Also, signals for displaying a picture having a desired gray level can be stored in the storage elements during the first enable interval of the second signal and the pictures having the desired gray level can be displayed until before the second enable interval. In addition, signals for displaying a picture having a black level can be stored in the storage elements during the second enable interval of the second signal and the pictures having the black level can be displayed until the end point of the frame.

Also, signals for displaying a picture having a black level can be stored in the storage elements during the first enable interval of the second signal and the pictures having the black level can be displayed until before the second enable interval. In addition, signals for displaying a picture having a desired gray level can be stored in the storage elements during the second enable interval of the second signal and the pictures having the desired gray level can be displayed until the end point of the frame.

The display period controller can include a counter for counting enable intervals in the third signal having a plurality of enable intervals inputted from the outside and a comparator for comparing a count value of the counter with a digital value representing brightness level of the first signal. At this time, the first enable interval of the second signal is produced corresponding to the first enable interval of the third signal, and then, as a result of comparison of the comparator, if the count value corresponds to the digital value, the second enable interval of the second signal is produced.

In addition, the flat panel display according to one aspect of the present invention can further include a photo-detector for producing the first signal representing the brightness level depending on ambient brightness.

In the flat panel display according to another aspect of the present invention, the pixels of the display panel are formed with capacitors for temporarily storing voltages corresponding to signals applied to the data lines responding to the scan signals applied to the scan lines and the pictures are displayed based on the voltages stored in the capacitors. Also, the display period controller controls a first period for storing a first voltage corresponding to a gray level of the picture to be displayed in the capacitors during one frame and a second period for storing a second voltage representing a black level in the capacitors, depending on a first signal representing a brightness level.

The display period controller receives a second signal in which a plurality of enable intervals are produced during one frame, produces a first scan signal for storing the first voltage in the capacitors with a correspondence to a first enable interval of enable intervals of the second signal, and produces a second scan signal for storing the second voltage in the capacitors with a correspondence to an enable interval selected based on a brightness level, of enable intervals of the second signal.

In addition, the display period controller includes a counter for receiving the second signal and counting enable intervals to produce a digital value having a specific range, and a converter for converting the brightness level of the first signal into a digital value within the range of the counter. A comparator compares the converted brightness level with the digital value of the counter to select the digital value for producing the second scan signal.

The counter outputs the digital value to which at least one upper bit having values circulated in turn depending on the number of frames is added, and the converter can convert the brightness level only when the upper bit corresponds to a prescribed bit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Preferred embodiments of the present invention will now be described in detail with reference to the accompanying drawings such that the present invention can be carried out by those skilled in the art. The present invention can be embodied in a variety of forms, and it is not limited to embodiments to be described below.

Hereinafter, a flat panel display according to embodiments of the present invention will be described in detail with reference to the accompanying drawings.

First, with reference to FIGS. 1 to 3, a flat panel display according to a first embodiment of the present invention will be described.

Figure 1:
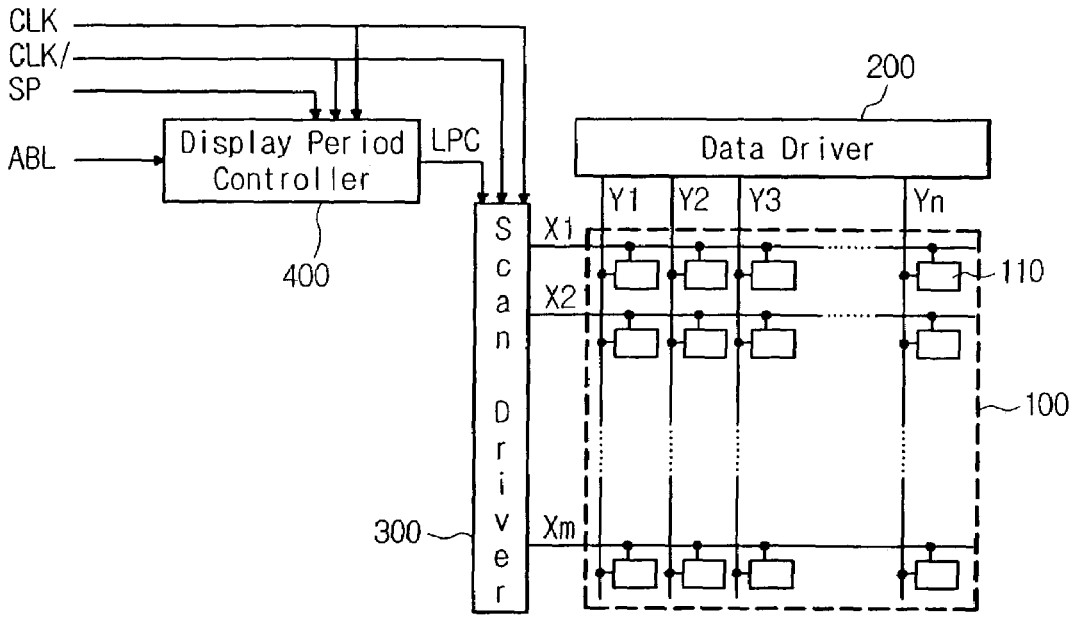
FIG. 1 is a view showing a schematic configuration of a flat panel display according to a first embodiment of the present invention.
Figure 2:
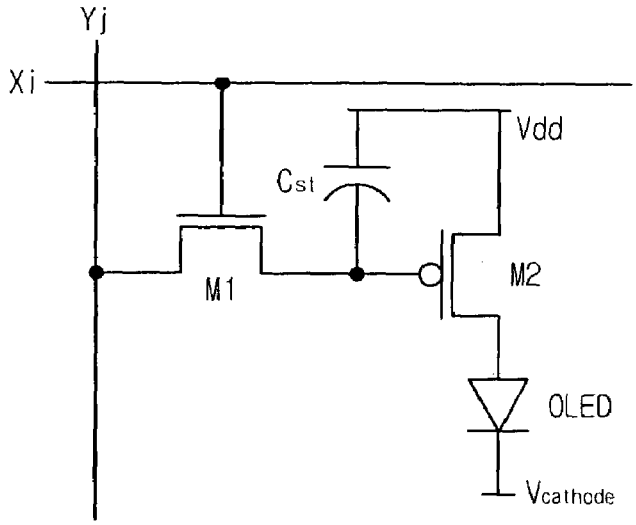
FIG. 2 is an equivalent circuitry diagram of a pixel in the flat panel display according to the first embodiment of the present invention.
Figure 3:
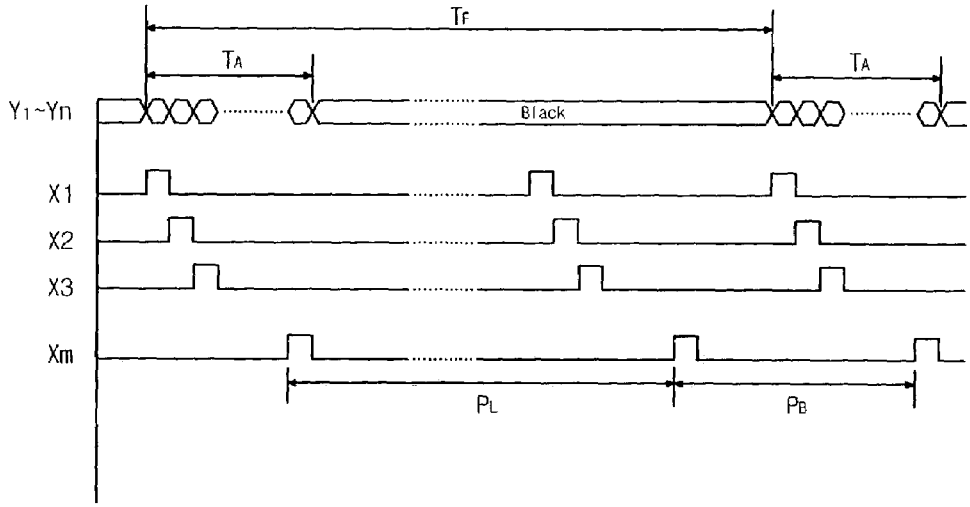
FIG. 3 is a signal timing diagram of the flat panel display according to the first embodiment of the present invention.

FIG. 1 is a view showing a schematic configuration of a flat panel display according to a first embodiment of the present invention, FIG. 2 is an equivalent circuitry diagram of a pixel in the flat panel display according to the first embodiment of the present invention, and FIG. 3 is a signal timing diagram of the flat panel display according to the first embodiment of the present invention.

As shown in FIG. 1, the flat panel display according to the first embodiment of the present invention includes a display panel 100, a data driver 200, a scan driver 300, and a display period controller 400.

In the display panel 100, a plurality of scan lines X1–Xm for transmitting selected signals are arranged in a vertical direction, and a plurality of data lines Y1–Yn for transmitting data signals are arranged in a horizontal direction. Also, in the display panel 100, a plurality of pixel circuits 110 for displaying pictures based on signals inputted through the plurality of scan lines X1–Xm and the plurality of data lines Y1–Yn are arranged in a matrix form.

As one example of such a pixel circuit 110, a pixel circuit of an organic electroluminescent display will be explained in the first embodiment of the present invention. As shown in FIG. 2, this pixel circuit 110 includes a switching element M1 responsive to a signal applied to a scan line Xi for transmitting a data voltage applied to a data line Yj. Also, the pixel circuit 110 includes a storage capacitor Cst connected between an output terminal of the switching element M1 and an external voltage Vdd for storing a voltage difference between the data voltage applied through the data line Yj and the external voltage Vdd. Another switching element M2 supplies current corresponding to the voltage difference stored in the storage capacitor Cst for the organic electroluminescent device OLED from which light emits when the current flows through it. A field effect transistor such as an NMOS (n-channel metal-oxide semiconductor) or PMOS (p-channel metal-oxide semiconductor) can be used as switching elements M1 and M2. In the pixel circuit 110, NMOS and PMOS transistors are used as switching elements M1 and M2, respectively. Alternatively, although the pixel circuit as shown in FIG. 2 is explained as an example in the first embodiment of the present invention, it is not limited to this but it may use any type of pixel circuit.

The data driver 200 applies the data voltages representing the picture signals to the data lines Y1–Yn and the scan driver 300 applies selection signals for selecting pixels 110 of the display panel 100 to each of the scan lines X1–Xm sequentially.

In addition, each of the data driver 200 and the scan driver 300 are connected to a glass substrate of the display panel. Alternatively, the data driver 200 and/or the scan driver 300 may be mounted directly on the glass substrate of the display panel 100, which is referred to as a "chip on glass (COG)"

method. In addition, the data driver 200 and/or the scan driver 300 can be replaced with a driving circuit composed of the same layers as the scan lines X1–Xm, the data lines Y1–Yn, and the transistors of the pixel circuit on the glass substrate of the display panel 100. Further, the data driver 200 and/or the scan driver 300 can be formed into a chip on a film connected electrically to the glass substrate of the display panel 100, which is referred to as a "chip on film (COF)" method.

Next, the display period controller 400 will be described in detail with reference to FIG. 3.

The display period controller 400 receives signals for setting brightness levels to be expressed in the flat panel display as inputs, produces display period control signals (hereinafter referred to as LPC signals) for controlling the display period based on the brightness levels, and supplies the LPC signals for the scan driver 300. As such signals for setting brightness levels, ambient brightness levels (ABLs) can be used. In order to produce the ABLs based on the ambient brightness, the flat panel display according to the embodiment of the present invention can further include a photo-detector (not shown). In addition, the ABLs can be values inputted by a user.

The enable period is generated twice in each frame of the LPC signals produced by the display period controller 400. Also, as shown in FIG. 3, the scan driver 300 provides the LPC signals to the scan lines X1–Xm while shifting them in turn. The LPC signals are applied to the gate of the switching element M1 in order to drive the switching element M1.

As the switching element M1 turns on in a first enable interval of the LPC signal applied to a scan line Xi, a corresponding voltage depending on the data voltage applied through the data lines Y1–Yn is stored in the storage capacitor Cst of the pixel circuit 110. Then, light is emitted from the organic electroluminescent device OLED such that the picture is displayed, depending on the stored voltage. In this way, data are stored in the pixel circuit 110 through all of the scan lines X1–Xm during an address period $T_A$. Next, when the address period $T_A$ is ended, data voltages for expressing the black level are applied to the data lines Y1–Yn as shown in FIG. 3. A voltage corresponding to the external voltage Vdd may be applied as the data voltage for expressing the black level to the pixel circuit 110 shown in FIG. 2. $T_F$ in FIG. 3 represents a frame period.

By doing so, the switching element M1 turns on in a second enable interval of the LPC signal so that a voltage corresponding to the data voltage of the black level applied through the data lines Y1–Yn, by which the picture of the black level is expressed, is stored in the storage capacitor Cst of the pixel circuit 110. Accordingly, a desired picture is expressed in a display period $P_L$ between the first and second enable periods of the LPC signal and the picture of the black level is expressed in a blank period $P_B$ between the second enable period and a first enable period of the next frame. In other words, the display period $P_L$ may be set long in order to express lighter brightness and the blank period $P_B$ may be set long in order to express darker brightness. Accordingly, the brightness can be determined by a ratio of the display period $P_L$ to the blank period $P_B$.

Next, a method for producing the LPC signal in the display period controller 400 will be described in detail with reference to FIGS. 4 and 5.

Figure 4:
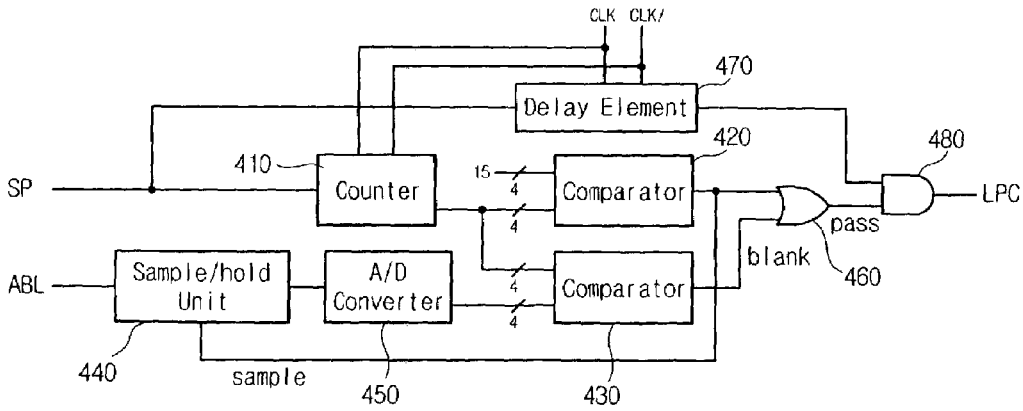
FIG. 4 is a block diagram of a display period controller according to the first embodiment of the present invention.
Figure 5:
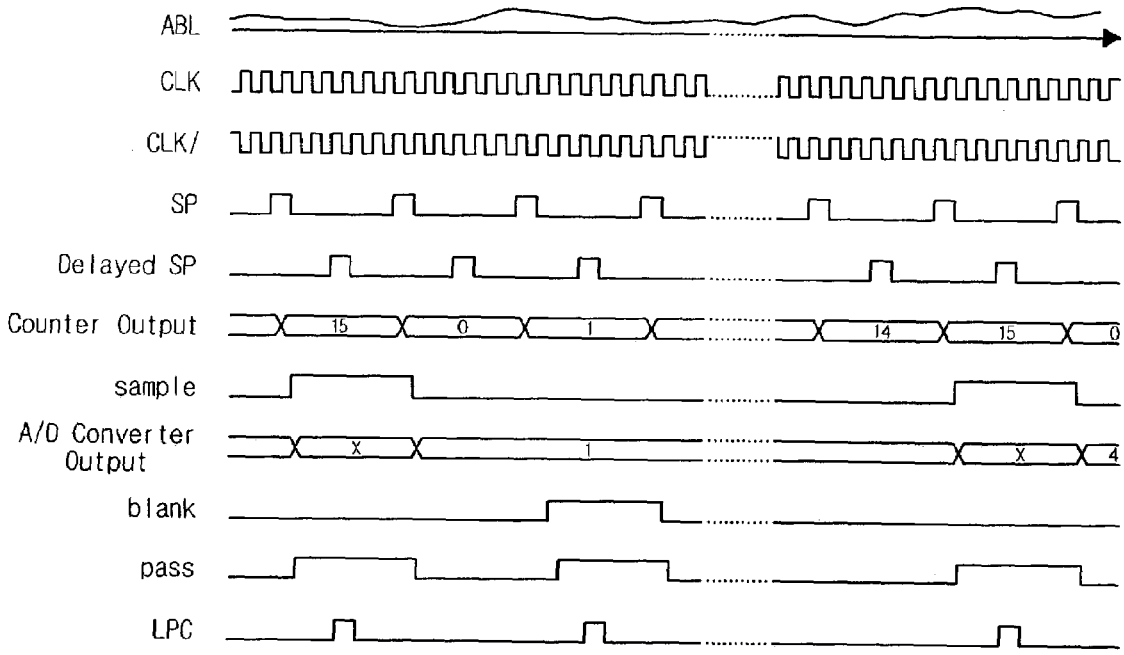
FIG. 5 is a signal timing diagram of the display period controller according to the first embodiment of the present invention.

FIG. 4 is a block diagram of the display period controller according to the first embodiment of the present invention, and FIG. 5 is a signal timing diagram of the display period controller according to the first embodiment of the present invention.

In the first embodiment of the present invention, it is assumed that the brightness is expressed to have 16 levels and in order to express these 16 levels of brightness a start pulse (hereinafter referred to as SP) signal having 16 enable intervals during one frame is periodically inputted to the display period controller 400.

As shown in FIG. 4, the display period controller 400 according to the first embodiment of the present invention includes a 4-bit counter 410 for producing counting values from '0000' (it is hereinafter assumed that all numbers inserted into the quotation symbols ' ' are binary numbers) to '1111' that are in turn based on the number of enable intervals of the SP signal inputted from the outside. Assuming that an initial value of the counter 410 is '1111', the counting value of '1111' is produced in a first enable interval of the SP signal, and other counting values are produced in turn, starting from '0000', from a second enable interval. In addition, an output of the counter 410 is supplied to one input of each of 4-bit comparators 420 and 430. Assuming that the other input of the comparator 420 is '1111', the comparator 420 outputs a signal of a high level only when the output of the counter 410 is '1111'.

In addition, a sample/hold unit 440 samples the ABL signal if the output of the comparator 420 has a high level, and an analog/digital (A/D) converter 450 converts the sampled ABL signal into digital values between '0000' and '1111'. The comparator 430 compares the output of the counter 410 with the output of the A/D converter 450, and outputs a signal of a high level if they are identical to each other.

The outputs of the comparators 420 and 430 are OR operated by an OR gate 460. A result of the OR operation and the SP signal delayed by a delay element 470 are AND operated by an AND gate 480, and a result of the AND operation is outputted as the LPC signal. The delay element 470 delays the SP signal by a unit of a half-period of the clock during a time interval that is longer than a delay time taken from when the SP signal is inputted to when the output of the OR gate 460 comes out.

Hereinafter, the operation of the display period controller 400 according to the first embodiment of the present invention will be described in detail with reference to FIGS. 4 and 5, for the case in which a desired brightness is a second level, as one example.

First, when the first enable pulse (high pulse) of the SP signal is applied, the counter 410 outputs '1111' as the initial value. Since the initial value '1111' is equal to the other input '1111' of the comparator 420, the comparator 420 outputs a signal of high level to be applied to one input of the OR gate 460. Accordingly, the output (indicated by 'pass' in FIG. 4) of the OR gate 460 becomes a signal of high level regardless of the other input of the OR gate 460. As the signal of high level from the OR gate 460 and the SP signal delayed in the delay element 470 are AND operated in the AND gate 480, the first enable pulse of the LPC signal is produced in an interval in which the delayed SP signal has a high level. In addition, the sample/hold unit 440 samples the ABL signal inputted thereto by means of an output of high level (indicated by 'sample' in FIG. 4) from the comparator 420. The A/D converter 450 converts the sampled ABL signal into a digital signal to output a desired brightness level ('0001' in the example explained here).

Next, as counting values produced in the counter 410 by the remaining enable pulses except the first enable pulse of the SP signal within one frame are '0000' to '1110', outputs of the comparator 420 always have a low level. Accordingly, an output ('pass') of the OR gate 460 has a high level only when an output ('blank') of the comparator 430 has a high level. Also, this output ('pass') is outputted as a signal of high level, which is a second enable pulse of the LPC signal, by the AND gate 480 only in an interval in which the SP signal delayed by the delay element 470 has a high level.

Accordingly, as the brightness level is '0001' in the example, an output of the counter 410 becomes '0001' only in a third enable interval of the SP signal and a second enable pulse of the LPC signal is produced by the output '0001'.

As described above, the switching element M1 of the pixel circuit 110 turns on by the first enable pulse of the LPC signal so that the data voltage to be displayed is stored and a picture having a desired gray level can be expressed by the stored data voltage. Also, when the switching element M1 turns on by the second enable pulse of the LPC signal, the data voltage of the black level is stored and the data of the black level is expressed until the first enable pulse of the LPC signal of the next frame is applied.

In other words, in the first embodiment of the present invention, a desired brightness can be expressed by controlling the display period $P_L$ in which a picture having a desired gray level is expressed and the blank period $P_B$ in which a picture having the black level is expressed. When a light brightness (a brightness of high level in the first embodiment of the present invention) is to be expressed, the display period $P_L$ becomes lengthened by inputting a value of brightness of high level, and when a dark brightness (a brightness of low level in the first embodiment of the present invention) is to be expressed, the display period $P_L$ becomes shortened by inputting a value of brightness of low level.

As described above, according to the first embodiment of the present invention, a variety of brightness levels can be expressed by controlling only an interval in which a picture having a desired gray level is displayed without changing a level of data voltage.

Although the display period controller shown in FIG. 4 has been exemplified in the first embodiment of the present invention, any display period controller may be used as long as the display period $P_L$ and the blank period $P_B$ can be controlled based on a level of brightness. In addition, although 16 levels of brightness were exemplified in the first embodiment of the present invention, a different number of brightness levels can be employed. For example, in the case of 20 levels of brightness, the number of enable intervals of the SP signal within one frame is 20, the counter shown in FIG. 4 produces counting values from 0 ('00000') to 19 ('10011'), and a 5-bit comparator is used as the comparator.

Although time intervals between enable intervals of the SP signal are all equal, as shown in FIG. 5, in the first embodiment of the present invention, different time intervals maybe employed.

In addition, although the pixel circuit of the organic electroluminescent display has been exemplified as the pixel circuit 110 in the first embodiment of the present invention, pixel circuits of different flat panel displays such as a liquid crystal display maybe employed as long as they have a means for storing data voltages applied to the pixel circuits.

Hereinafter, another embodiment which is applied to the liquid crystal device will be described in detail with reference to FIGS. 6 and 7.

Figure 6:
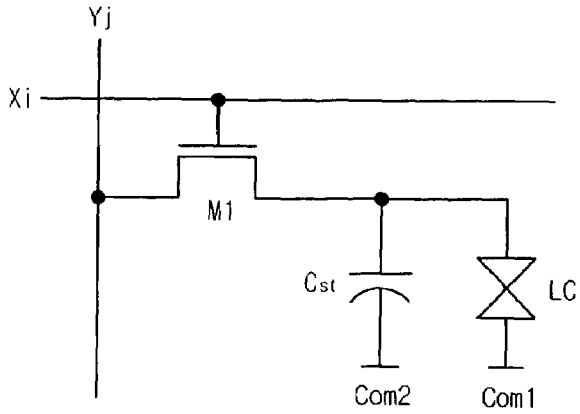
FIG. 6 is an equivalent circuitry diagram of a pixel in a flat panel display according to a second embodiment of the present invention.
Figure 7:
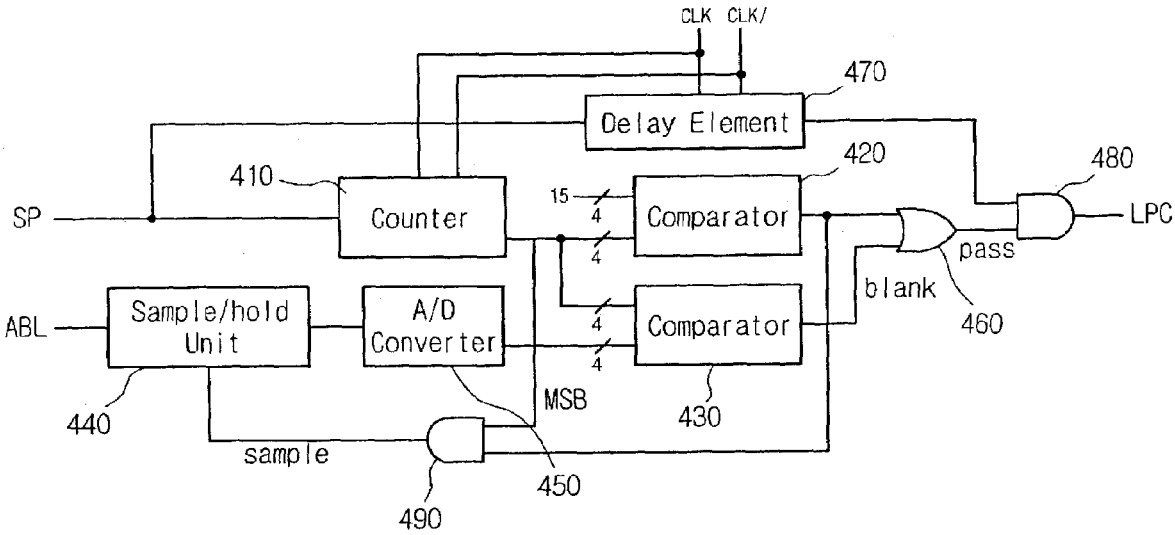
FIG. 7 is a block diagram of a display period controller of the flat panel display according to the second embodiment of the present invention.

FIG. 6 is an equivalent circuitry diagram of a pixel circuit in a flat panel display according to a second embodiment of the present invention and FIG. 7 is a block diagram of a display period controller of the flat panel display according to the second embodiment of the present invention.

As shown in FIG. 6, the pixel circuit includes a switching element M1 responsive to a signal applied to a scan line Xi for delivering a data voltage applied to a data line Yj. Also, the pixel circuit includes a storage capacitor Cst connected to an output of the switching element M1 for storing the data voltage applied through the data line. In addition, between the output of the switching element M1 and a common voltage Com1 is connected a liquid crystal cell LC to be driven by the data voltage stored in the storage capacitor Cst and the common voltage Com1 in order to express a picture. Alternatively, although the pixel circuit as shown in FIG. 6 is explained as an example in the second embodiment of the present invention, it is not limited to this and it may use any type of pixel circuit.

In the second embodiment, in the same manner as in the first embodiment, a data voltage to express a desired gray level is applied to the storage capacitor Cst of the pixel circuit during an address period $T_A$, and a data voltage to express the black level is applied to the data lines Y1–Ym when the address period $T_A$ is finished. If the liquid crystal display using the pixel circuit shown in FIG. 6 is a normally black panel, a voltage corresponding to the common voltage Com1 is applied as the data voltage to express the black level. If such a liquid crystal display is a normally white panel, positive and negative data voltages giving the maximal difference of voltage across the liquid crystal are alternatively applied every frame.

In addition, as it is common in the liquid crystal display that positive and negative voltages are alternatively applied to the data lines every frame, the display periods $P_L$ of two frames to which the positive and negative voltages are applied have to be equal to each other. For the purpose of this, the display period controller as shown in FIG. 7 is used. This display period controller is equivalent to that shown in FIG. 4 except for a 5-bit counter 410 and an AND gate 490.

Particularly, the 5-bit counter 410 of the display period controller shown in FIG. 7 outputs the 4-bit counting value added by the most significant bit (MSB) having '1' and '0' alternately every frame. In other words, the counter 410 outputs '11111', '10000', '10001', '110010', . . . , '111110' in that order in odd-numbered frames and '01111', '00000', '00001', '00010', . . . , '01110' in that order in even-numbered frames.

At that time, the comparators 420 and 430 compare only the lower 4 bits of the output of the counter 410 with other inputs. Then, an output of the comparator 420 and the MSB of the counter 410 are operated by the AND gate 490 and the sample/hold unit 440 performs sampling only when a result of the operation shows a high level. Accordingly, the ABL signal is sampled only in a frame in which the MSB in the output of the counter 410 is '1' and a result derived from this sampling is applied as it is in the next frame. Accordingly, the display periods $P_L$ of the two frames are equal to each other. Detailed description of other operations will be omitted since they are equivalent to those of the display period controller shown in FIG. 4.

Although the brightness level was controlled at one frame interval in the first embodiment and at two frame intervals in the second embodiment, alternatively, it may be controlled at more frame intervals. For example, if the brightness level is to be controlled at 8 frame intervals, the counter of the display period controller may be a 7-bit counter, the upper 3-bit is set as '111', '110', '101', . . . , '000' for each frame, and the sample/hold unit 440 performs sampling only when the upper 3-bit is '111'.

In addition, although a picture display based on the data voltage has been exemplified in the first and second embodiments, the present invention can be applied to a display of a picture based on a current.

Hereinafter, the flat panel display to be programmed in a current mode will be described in detail with reference to FIGS. 8 and 9.

Figure 8:
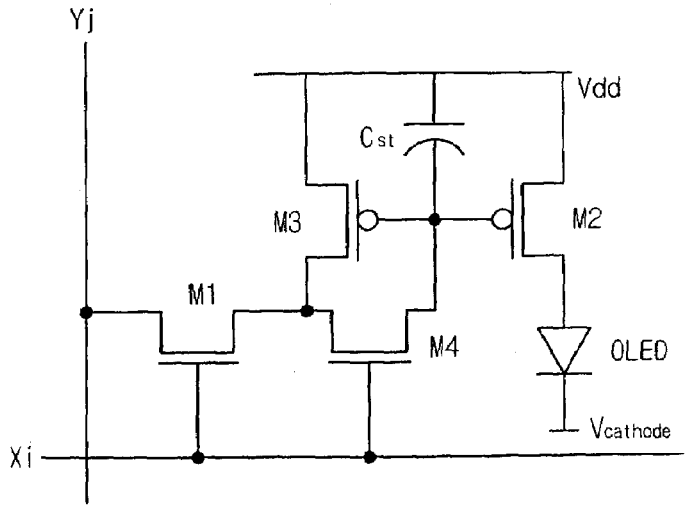
FIGS. 8 and 9 are equivalent circuitry diagrams of a pixel in a flat panel display according to third and fourth embodiments of the present invention.
Figure 9:
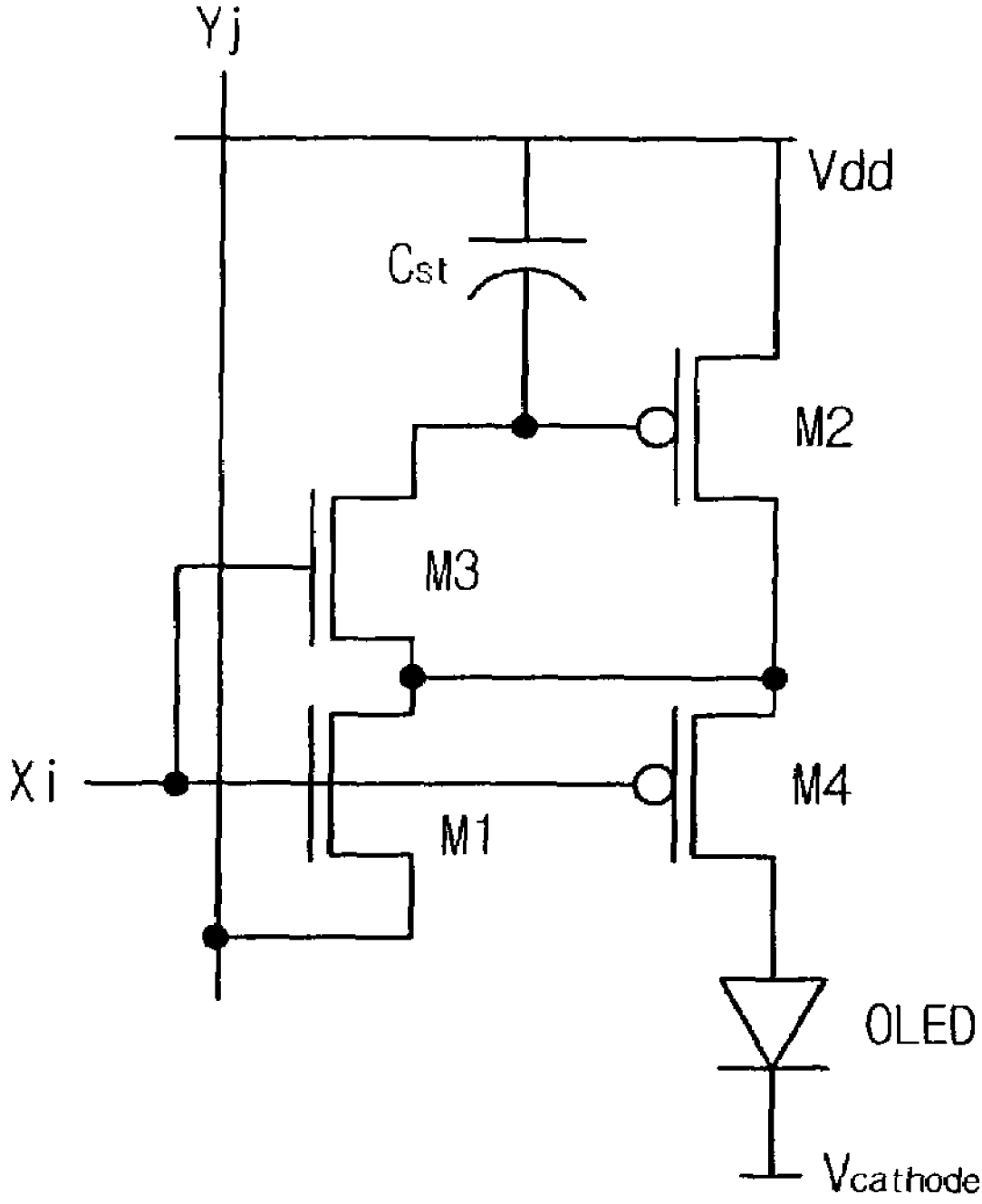

FIGS. 8 and 9 are equivalent circuitry diagrams of a pixel in a flat panel display according to third and fourth embodiments of the present invention.

Since the display period controller shown in prior embodiments can be also applied to the flat panel display of the third and fourth embodiments, only the operation of the pixel circuit will be described hereinafter.

As shown in FIG. 8, in the pixel circuit of the third embodiment, a switching element M3 serves as a diode when switching elements M1 and M4 turn on in an enable interval of the LPC signal applied through the scan line Xi. Then, a voltage for displaying a picture is charged in the storage capacitor Cst until a current flowing through the switching element M3 becomes equal to a current flowing through the data line Yj.

As shown in FIG. 9, in the pixel circuit of the fourth embodiment, a switching element M2 serves as a diode when switching elements M1 and M3 turn on and a switching element M4 turns off in an enable interval of the LPC signal applied through the scan line Xi. Then, as described previously, a voltage for displaying a picture is charged in the storage capacitor Cst until a current flowing through the switching element M2 becomes equal to a current flowing through the data line Yj.

In order to display the black level during the blank period $P_B$ in the pixel circuit in the third and fourth embodiments, no current is supplied for the data line Yj after the address period $T_A$. Then, the data line Yj is floated and hence a voltage corresponding to the black level is charged in the storage capacitor Cst. Accordingly, the pixel circuit displays a picture of black level in the second enable interval of the LPC signal.

Although a picture of the black level was displayed after an actual picture was displayed in one frame, contrariwise an actual picture may be displayed after a picture of the black level is displayed. In other words, the voltage corresponding to the black level is stored in the storage capacitor in the first enable interval of the LPC signal and the voltage corresponding to the actual picture is stored in the storage capacitor in the second enable interval of the LPC signal.

The present invention can be implemented as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

Figure 10:
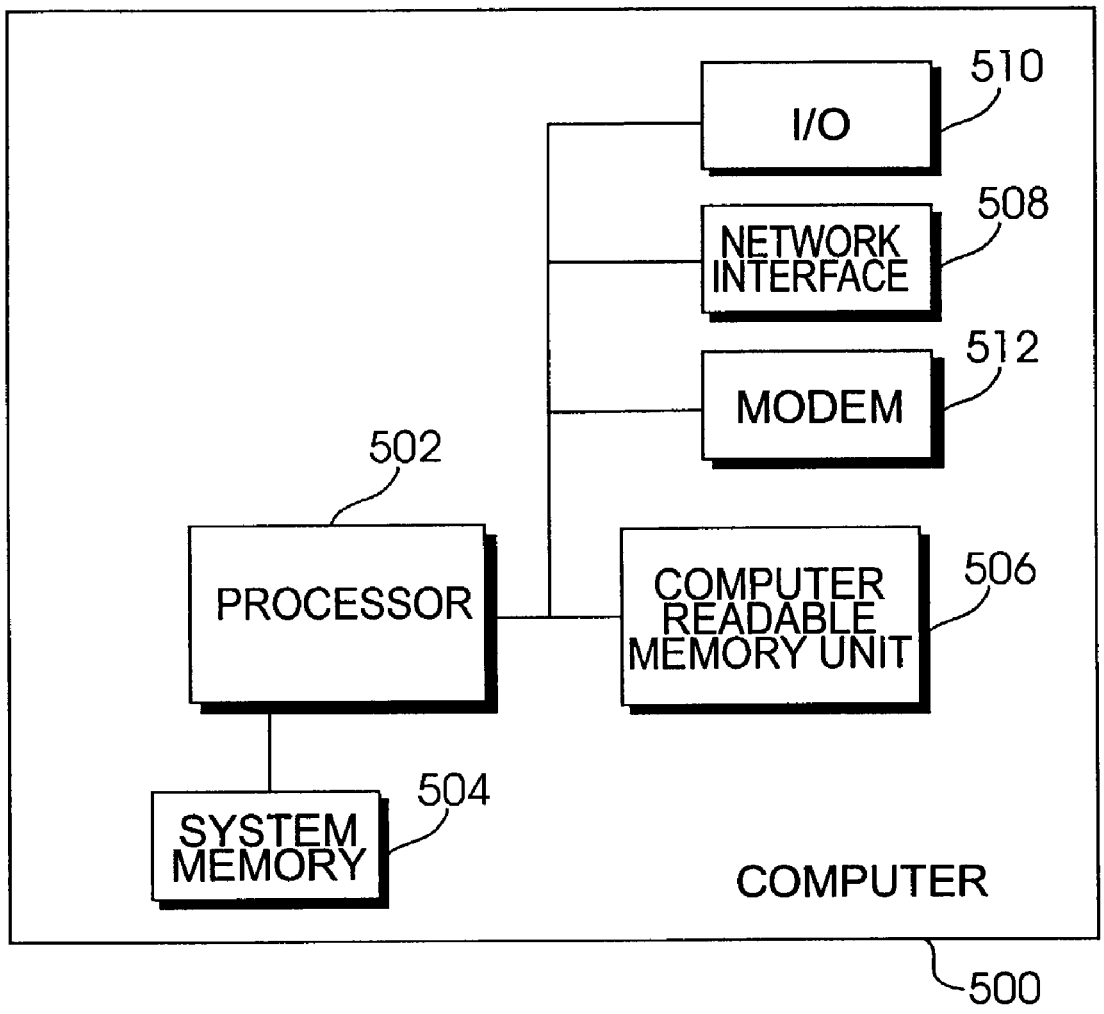
FIG. 10 is an example of a computer that can read computer-readable media including computer-executable instructions of the present invention.

An example of a computer, but not limited to this example of the computer, that can read computer readable media that includes computer-executable instructions of the present invention is shown in FIG. 10. The computer 500 includes a processor 502 that controls the computer 500. The processor 502 uses the system memory 504 and a computer readable memory device 506 that includes certain computer readable recording media. A system bus connects the processor 502 to a network interface 508, modem 512 or other interface that accommodates a connection to another computer or network such as the Internet. The system bus may also include an input and output interface 510 that accommodates connection to a variety of other devices.

As described above, according to the present invention, brightness of a variety of levels can be expressed without an adjustment of the data voltage. In other words, when one frame is divided into the display period in which a desired picture is displayed and the blank period in which a picture of the black level is displayed, the brightness can be expressed by controlling the display period and the blank period properly.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A flat panel display comprising:

a display panel including a plurality of scan lines and a plurality of data lines, intersecting each other, and a plurality of pixels for displaying pictures based on signals applied to the plurality of data lines in response to signals applied to the plurality of scan lines;

a display period controller receiving a first signal and then producing a second signal including first and second enable intervals during one frame; and a scan driver for delivering said second signal to the plurality of scan lines in turn, with said one frame being divided into a first period between said first and second enable intervals and a second period between said second enable interval and an end point of the frame, and the pixels displaying pictures having a desired gray level in one of said first and second periods and pictures including a black level in the other of said first and second periods.

2. The flat panel display of claim 1, wherein said display period controller receives a third signal having a plurality of enable intervals during one frame, selects two enable intervals depending on a level of brightness, and produces said second signal with a correspondence of said two selected enable intervals to said first and second enable intervals.

3. The flat panel display of claim 2, wherein the pixels comprise:

storage elements for storing signals corresponding to signals applied from said data lines, with signals for displaying pictures including the desired gray level are stored in said storage elements during said first enable interval of said second signal and the pictures having the desired gray level can be displayed until before said second enable interval, and with signals for displaying pictures including the black level are stored in said storage elements during said second enable interval of said second signal and the pictures having the black level can be displayed until the end point of the frame.

4. The flat panel display of claim 2, wherein the pixels comprise:

storage elements for storing signals corresponding to signals applied from the data lines, with signals for displaying pictures including the black level are stored in said storage elements during said first enable interval of said second signal and the pictures including the black level can be displayed until before said second enable interval, and with signals for displaying pictures including the desired gray level are stored in said storage elements during said second enable interval of said second signal and the pictures including the desired gray level can be displayed until the end point of the frame.

5. The flat panel display of claim 1, wherein the pixels include storage elements storing signals corresponding to signals applied from the data lines, and the pictures are displayed in the pixels by the signals stored in said storage elements.

6. The flat panel display of claim 5, wherein signals corresponding to the signals applied from the data lines are stored in said storage elements in said first and second enable intervals of said second signal.

7. The flat panel display of claim 5, wherein said display period controller comprises:

a counter for counting enable intervals in a third signal including a plurality of enable intervals inputted from the outside, and a comparator for comparing a count value of said counter with a digital value of brightness level of said first signal, said first enable interval of said second signal and said digital value of brightness level are determined corresponding to a first enable interval of said third signal, and then, as a result of comparison of said comparator, when said count value corresponds to said digital value, said second enable interval of said second signal is produced.

8. The flat panel display of claim 1, further comprising a photo-detector producing said first signal representing the brightness level depending on ambient brightness.

9. The flat panel display of claim 3, wherein the second enable interval of said second signal is the next enable interval after the first enable interval, where the second signal is the only signal provided from said scan driver to each of the scan lines.

10. The flat panel display of claim 1, wherein said display period controller comprises:

a counter for counting enable intervals in a third signal including a plurality of enable intervals inputted from the outside, and a comparator for comparing a count value of said counter with a digital value of brightness level of said first signal, said first enable interval of said second signal and said digital value of brightness level are determined corresponding to a first enable interval of said third signal, and then, as a result of comparison of said comparator, when said count value corresponds to said digital value, said second enable interval of said second signal is produced.

11. The flat panel display of claim 1, wherein the pixels displaying pictures having a desired gray level exclusively in one of said first and second periods and pictures including a black level exclusively in the other of said first and second periods.

12. A flat panel display comprising:

a display panel including pixels formed with capacitors for temporarily storing voltages corresponding to signals applied to data lines in response to scan signals applied to scan lines, the pixels displaying a picture based on the voltages stored in said capacitors; and a display period controller for controlling a first period for storing a first voltage corresponding to a gray level of the picture to be displayed in the capacitors during one frame and a second period for storing a second voltage representing a black level in said capacitors, according to a first signal representing a brightness level.

13. The flat panel display of claim 12, wherein said display period controller receives a second signal in which a plurality of enable intervals are produced during one frame, produces a first scan signal for storing said first voltage in said capacitors corresponding to a first one of enable intervals of said second signal, and produces a second scan signal for storing said second voltage in said capacitors corresponding to an enable interval, selected based on the brightness level, of enable intervals of said second signal.

14. The flat panel display of claim 13, wherein said display period controller comprises:

a counter receiving said second signal and counting enable intervals to produce a digital value having a specific range;

a converter for converting the brightness level of said first signal into a value within the range of the digital value of said counter; and a comparator for comparing the converted brightness level with the digital value of said counter to select said second scan signal.

15. The flat panel display of claim 14, wherein said counter outputs the digital value to which at least one upper bit having values circulated in turn depending on the number of frames is added, and said converter converts the brightness level only when the upper bit corresponds to a prescribed bit.

16. The flat panel display of claim 12, wherein said display period controller receives a second signal in which a plurality of enable intervals are produced during one frame, produces a first scan signal for storing said second voltage in said capacitors corresponding to a first one of enable intervals of said second signal, and produces a second scan signal for storing said first voltage in said capacitors corresponding to an enable interval, selected based on the brightness level, of enable intervals of said second signal.

17. The flat panel display of claim 16, wherein said display period controller comprises:

a counter receiving said second signal and counting enable intervals to produce a digital value having a specific range;

a converter for converting the brightness level of said first signal into a value within the range of the digital value of said counter; and a comparator for comparing the converted brightness level with the digital value of said counter to select said second scan signal.

18. The flat panel display of claim 17, wherein said counter outputs the digital value to which at least one upper bit having values circulated in turn depending on the number of frames is added, and said converter converts the brightness level only when the upper bit corresponds to a prescribed bit.

19. The flat panel display of claim 12, further comprising a photo-detector producing said first signal representing the brightness level depending on ambient brightness.

20. A computer-readable medium having computer-executable instructions for performing a method in a flat panel display, comprising:

receiving a first signal and then producing a second signal including first and second enable intervals during one frame;

dividing the one frame into a first period between said first and second enable intervals and a second period between said second enable interval and an end point of the frame, and the pixels displaying pictures having a desired gray level in one of said first and second periods and pictures including a black level in the other of said first and second periods; and delivering said second signal to a plurality of scan lines in a display panel in turn, said display panel including the plurality of scan lines and a plurality of data lines, intersecting each other, and a plurality of pixels for displaying pictures based on signals applied to the plurality of data lines in response to signals applied to the plurality of scan lines.

21. The computer-readable medium of claim 20, further comprising of:

storing signals for displaying pictures including the desired gray level during said first enable interval of said second signal and the pictures having the desired gray level can be displayed until before said second enable interval; and storing signals for displaying pictures including the black level during said second enable interval of said second signal and the pictures having the black level can be displayed until the end point of the frame.

* * * * *